US010480160B2

(12) United States Patent
Tanishige et al.

(10) Patent No.: US 10,480,160 B2
(45) Date of Patent: Nov. 19, 2019

(54) WORK VEHICLE AND METHOD OF CONTROLLING WORK VEHICLE

(71) Applicant: KOMATSU LTD., Tokyo (JP)

(72) Inventors: Akira Tanishige, Tokyo (JP); Yoshiki Kami, Tokyo (JP); Takashi Yokoo, Tokyo (JP); Yuto Fujii, Tokyo (JP); Haruki Nishiguchi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/540,077

(22) PCT Filed: Nov. 9, 2016

(86) PCT No.: PCT/JP2016/083218
§ 371 (c)(1),
(2) Date: Jun. 27, 2017

(87) PCT Pub. No.: WO2018/087833
PCT Pub. Date: May 17, 2018

(65) Prior Publication Data

US 2018/0266082 A1 Sep. 20, 2018

(51) Int. Cl.

| | |
|---|---|
| ***E02F 9/26*** | (2006.01) |
| ***E02F 3/43*** | (2006.01) |
| ***E02F 9/22*** | (2006.01) |
| ***E02F 3/30*** | (2006.01) |
| ***E02F 3/36*** | (2006.01) |

(52) U.S. Cl.
CPC ..... *E02F 9/264* (2013.01); *E02F 3/307* (2013.01); *E02F 3/3677* (2013.01); *E02F 3/434* (2013.01); *E02F 9/2228* (2013.01); *E02F 9/2271* (2013.01); *E02F 9/2285* (2013.01); *E02F 9/2296* (2013.01); *E02F 9/267* (2013.01)

(58) Field of Classification Search
CPC ..... E02F 9/264; E02F 9/2228; E02F 3/307; E02F 3/434
USPC ..... 340/438
See application file for complete search history.

(56) References Cited

U.S. PATENT DOCUMENTS

| | | | |
|---|---|---|---|
| 2004/0133327 | A1 | 7/2004 | Ishimoto et al. |
| 2004/0186687 | A1 | 9/2004 | Ogura et al. |
| 2006/0031042 | A1 | 2/2006 | Ogura et al. |
| 2007/0168101 | A1 | 7/2007 | Shibamori et al. |
| 2012/0169489 | A1 | 7/2012 | Gocho et al. |

(Continued)

FOREIGN PATENT DOCUMENTS

| | | | |
|---|---|---|---|
| JP | 2000-054423 | A | 2/2000 |
| JP | 2002-332664 | A | 11/2002 |

(Continued)

*Primary Examiner* — Omar Casillashernandez
(74) *Attorney, Agent, or Firm* — Drinker Biddle & Reath LLP

(57) ABSTRACT

A main controller controlling an operation of a work vehicle includes a determination unit and an abnormal condition determination unit. The determination unit determines whether or not an attachment has a sensor based on information on an attachment. When the determination unit determines that the attachment has the sensor and when the abnormal condition determination unit cannot receive a signal from the sensor, the abnormal condition determination unit determines that an abnormal condition has occurred.

7 Claims, 9 Drawing Sheets

(56) References Cited

U.S. PATENT DOCUMENTS

| | | | | |
|---|---|---|---|---|
| 2012/0232756 | A1* | 9/2012 | Yuan | E02F 9/226 701/41 |
| 2013/0080104 | A1* | 3/2013 | Boehl | G01D 5/24471 702/94 |
| 2013/0292482 | A1 | 11/2013 | Hashigaya et al. | |
| 2015/0047427 | A1* | 2/2015 | Ikegami | E02F 9/2271 73/168 |
| 2015/0278638 | A1 | 10/2015 | Kang | |
| 2015/0354178 | A1* | 12/2015 | Jeong | E02F 9/267 340/438 |
| 2016/0237654 | A1* | 8/2016 | Arimatsu | E02F 9/26 |
| 2018/0002900 | A1* | 1/2018 | Morimoto | E02F 9/264 |
| 2019/0093321 | A1* | 3/2019 | Hiekata | E02F 3/36 |

FOREIGN PATENT DOCUMENTS

| | | | |
|---|---|---|---|
| JP | 2005-307483 | A | 11/2005 |
| JP | 2009-83586 | A | 4/2009 |
| JP | 2010-1613 | A | 1/2010 |
| JP | 2011-112622 | A | 6/2011 |
| JP | 2011-179215 | A | 9/2011 |
| JP | 2012-1913 | A | 1/2012 |
| JP | 2012-57326 | A | 3/2012 |
| JP | 2013-233823 | A | 11/2013 |
| JP | 5886962 | B1 | 3/2016 |
| KR | 10-2003-0014325 | A | 2/2003 |
| KR | 10-2015-0058232 | A | 5/2015 |
| KR | 10-2015-0142031 | A | 12/2015 |
| WO | WO-2014/167728 | A1 | 10/2014 |

* cited by examiner

WORK VEHICLE AND METHOD OF CONTROLLING WORK VEHICLE

TECHNICAL FIELD

The present invention relates to a work vehicle and a method of controlling a work vehicle.

BACKGROUND ART

In connection with a conventional work vehicle, International Publication WO2014/167728 (PTD 1) discloses diagnosis of an operation state of a position sensor detecting a stroke position of a hydraulic cylinder driving a work implement when a notification about an abnormal condition of a stroke operation of the hydraulic cylinder is received.

CITATION LIST

Patent Document

PTD 1: International Publication WO2014/167728

SUMMARY OF INVENTION

Technical Problem

PTD 1 describes measurement with a dedicated instrument by a serviceperson for sensing of a break which has occurred in a position sensor. It is troublesome, however, to carry a dedicated instrument and conduct measurement for sensing a break in the position sensor.

An object of the present invention is to provide a work vehicle in which an abnormal condition of a sensor provided in a work implement can easily and quickly be sensed and a method of controlling a work vehicle.

Solution to Problem

A work vehicle according to one aspect of the present invention includes a vehicular main body and a work implement attached to the vehicular main body. The work implement has a removable attachment. The work vehicle includes a controller controlling an operation of the work vehicle. The controller includes a determination unit and an abnormal condition determination unit. The determination unit determines whether or not the attachment has a sensor based on information on the attachment. The abnormal condition determination unit determines that an abnormal condition has occurred when the determination unit determines that the attachment has the sensor and when the abnormal condition determination unit cannot receive a signal from the sensor.

In the work vehicle, the information on the attachment includes information on a shape of the attachment.

In the work vehicle, the information on the attachment includes information on the attachment having the sensor and information on the attachment without the sensor.

In the work vehicle, the attachment is a bucket.

In the work vehicle, the work implement has a boom attached to the vehicular main body as being pivotable with respect to the vehicular main body and an arm attached to the boom as being pivotable with respect to the boom. The bucket is attached to the arm as being pivotable around a bucket axis defining an axis of pivot with respect to the arm and around a tilt axis orthogonal to the bucket axis.

The work vehicle further includes a notification unit giving a notification about an abnormal condition when the abnormal condition determination unit determines that an abnormal condition has occurred.

A work vehicle according to one aspect of the present invention includes a vehicular main body and a work implement attached to the vehicular main body. The work implement has a removable attachment. A method of controlling the work vehicle includes determining whether or not the attachment has a sensor based on information on the attachment and determining that an abnormal condition has occurred when it is determined that the attachment has the sensor and when a signal from the sensor cannot be received.

Advantageous Effects of Invention

In connection with a work vehicle and a method of controlling a work vehicle, an abnormal condition of a sensor provided in a work implement can easily and quickly be sensed.

DESCRIPTION OF EMBODIMENTS

Figure 1:
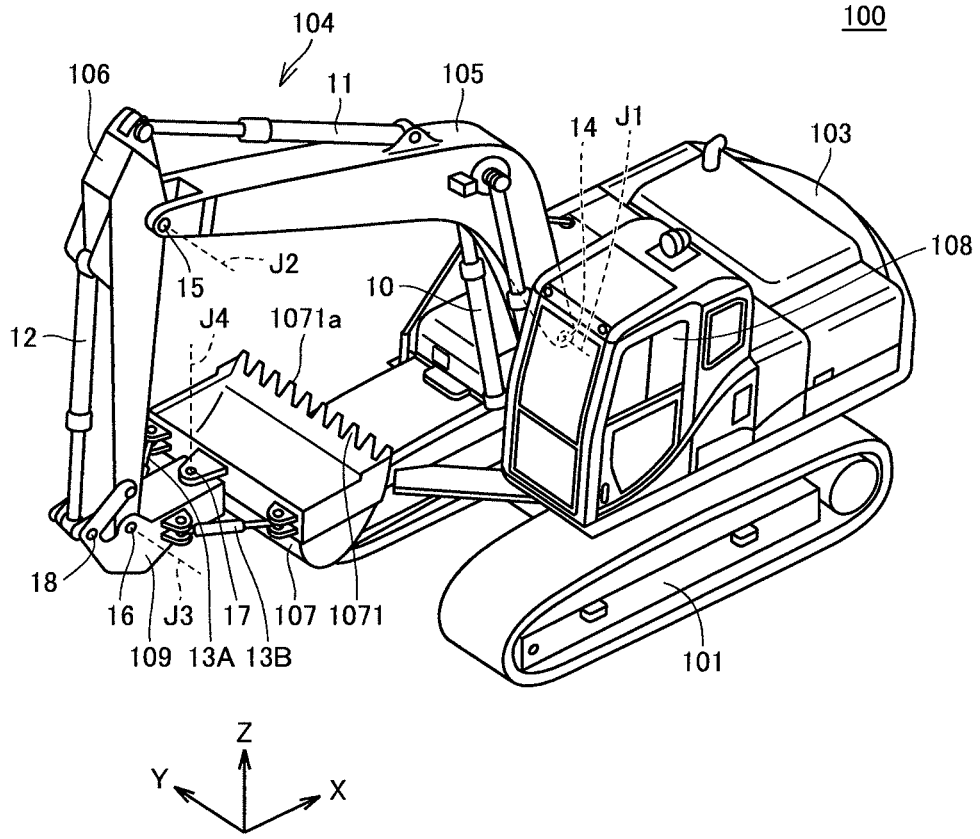
FIG. 1 is a diagram illustrating appearance of a work vehicle based on an embodiment.

An embodiment will be described hereinafter with reference to the drawings. In the description below, the same elements have the same reference characters allotted. Their label and function are also identical. Therefore, detailed description thereof will not be repeated.

Combination of features in the embodiment as appropriate is originally intended. Some constituent elements may not be used.

[Overall Construction of Work Vehicle]

A construction of a hydraulic excavator will initially be described by way of example of a work vehicle 100. FIG. 1 is a diagram illustrating appearance of work vehicle 100 based on an embodiment.

As shown in FIG. 1, work vehicle 100 mainly has a travel unit 101, a revolving unit 103, and a work implement 104. A main body of the work vehicle is constituted of travel unit 101 and revolving unit 103. Travel unit 101 has a pair of left and right crawler belts. Revolving unit 103 is revolvably attached with a revolving mechanism above travel unit 101 being interposed. Revolving unit 103 includes an operator's cab 108.

Work implement 104 is pivotally supported by revolving unit 103 as being operable in an upward/downward direction and performs such an operation as excavation of soil. Work implement 104 operates with a hydraulic oil supplied from a hydraulic pump (see FIG. 3). Work implement 104 includes a boom 105, an arm 106, a bucket 107, a boom cylinder 10, an arm cylinder 11, a bucket cylinder 12, and tilt cylinders 13A and 13B.

In the present embodiment, positional relation among components will be described with work implement 104 being defined as the reference.

Boom 105 of work implement 104 pivots around a boom pin 14 with respect to revolving unit 103. A trace of movement of a specific portion of boom 105 which pivots with respect to revolving unit 103, such as a tip end portion of boom 105, is in an arc shape, and a plane including the arc is specified. When work vehicle 100 is planarly viewed, the plane is shown as a straight line. A direction in which this straight line extends is a fore/aft direction of a main body of the work vehicle or a fore/aft direction of revolving unit 103, and it is also simply referred to as the fore/aft direction below. A lateral direction (a direction of vehicle width) of the main body of the work vehicle or a lateral direction of revolving unit 103 is a direction orthogonal to the fore/aft direction in a plan view and also simply referred to as the lateral direction below. An upward/downward direction of the main body of the work vehicle or an upward/downward direction of revolving unit 103 is a direction orthogonal to the plane defined by the fore/aft direction and the lateral direction and also simply referred to as the upward/downward direction below.

A side in the fore/aft direction where work implement 104 protrudes from the main body of the work vehicle is defined as the fore direction, and a direction opposite to the fore direction is defined as the aft direction. A right side and a left side in the lateral direction when one faces the fore direction are defined as a right direction and a left direction, respectively. A side in the upward/downward direction where the ground is located is defined as a lower side and a side where the sky is located is defined as an upper side. The fore/aft direction is shown with an X direction in FIG. 1, the lateral direction is shown with an Y direction, and the upward/downward direction is shown with a Z direction.

The fore/aft direction refers to a fore/aft direction of an operator who sits at an operator's seat in operator's cab 108. The lateral direction refers to a lateral direction of the operator who sits at the operator's seat. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

A base end portion of boom 105 (boom foot) is attached to revolving unit 103 with boom pin 14 being interposed. A base end portion of arm 106 (arm foot) is attached to a tip end portion of boom 105 (boom top) with an arm pin 15 being interposed. A coupling member 109 is attached to a tip end portion of arm 106 (arm top) with a bucket pin 16 being interposed. Coupling member 109 is coupled to bucket cylinder 12 with a cylinder pin 18 being interposed.

Bucket 107 is attached to coupling member 109 with a tilt pin 17 being interposed. Bucket 107 is attached to arm 106 with coupling member 109 being interposed. Bucket 107 is provided at a tip end portion of work implement 104. Bucket 107 represents one example of an attachment removably attached to the tip end of work implement 104.

Boom pin 14, arm pin 15, and bucket pin 16 are arranged in positional relation in parallel to one another. Boom pin 14, arm pin 15, and bucket pin 16 extend laterally.

Boom pin 14 has a boom axis J1. Arm pin 15 has an arm axis J2. Bucket pin 16 has a bucket axis J3. Tilt pin 17 has a tilt axis J4. Boom axis J1, arm axis J2, and bucket axis J3 each extend in the Y direction.

Boom 105 can pivot with respect to the main body of the work vehicle around boom axis J1 defining an axis of pivot. Arm 106 can pivot with respect to boom 105, around arm axis J2 defining an axis of pivot in parallel to boom axis J1. Bucket 107 can pivot with respect to arm 106, around bucket axis J3 defining an axis of pivot in parallel to boom axis J1 and arm axis J2. Bucket 107 can pivot with respect to arm 106 around tilt axis J4 defining an axis of pivot orthogonal to bucket axis J3.

Boom cylinder 10 drives boom 105. Arm cylinder 11 drives arm 106. Bucket cylinder 12 drives coupling member 109 and bucket 107. Boom cylinder 10, arm cylinder 11, bucket cylinder 12, and tilt cylinders 13A and 13B are all hydraulic cylinders driven with a hydraulic oil.

[Construction of Bucket]

Bucket 107 is called a tilting bucket. Bucket 107 is coupled to the tip end portion of arm 106 with coupling member 109 and bucket pin 16 being interposed. Bucket 107 is attached to coupling member 109 as being pivotable around a central axis of bucket pin 16 as bucket cylinder 12 extends or contracts.

In coupling member 109, bucket 107 is attached on a side of bucket 107 opposite to a side of coupling member 109 where bucket pin 16 is attached, with tilt pin 17 being interposed. Tilt pin 17 is orthogonal to bucket pin 16. Bucket 107 is attached to coupling member 109 with tilt pin 17 being interposed so as to be pivotable around a central axis of tilt pin 17.

According to such a structure, bucket 107 can pivot around a central axis of bucket pin 16 and around the central axis of tilt pin 17. An operator can incline a cutting edge 1071*a* with respect to the ground by pivoting bucket 107 around the central axis of tilt pin 17.

Bucket 107 includes a plurality of blades 1071. The plurality of blades 1071 are attached to an end portion of bucket 107 opposite to a side where tilt pin 17 is attached. The plurality of blades 1071 are disposed in a direction orthogonal to tilt pin 17. The plurality of blades 1071 are aligned. Cutting edges 1071*a* of the plurality of blades 1071 are also aligned.

Figure 2:
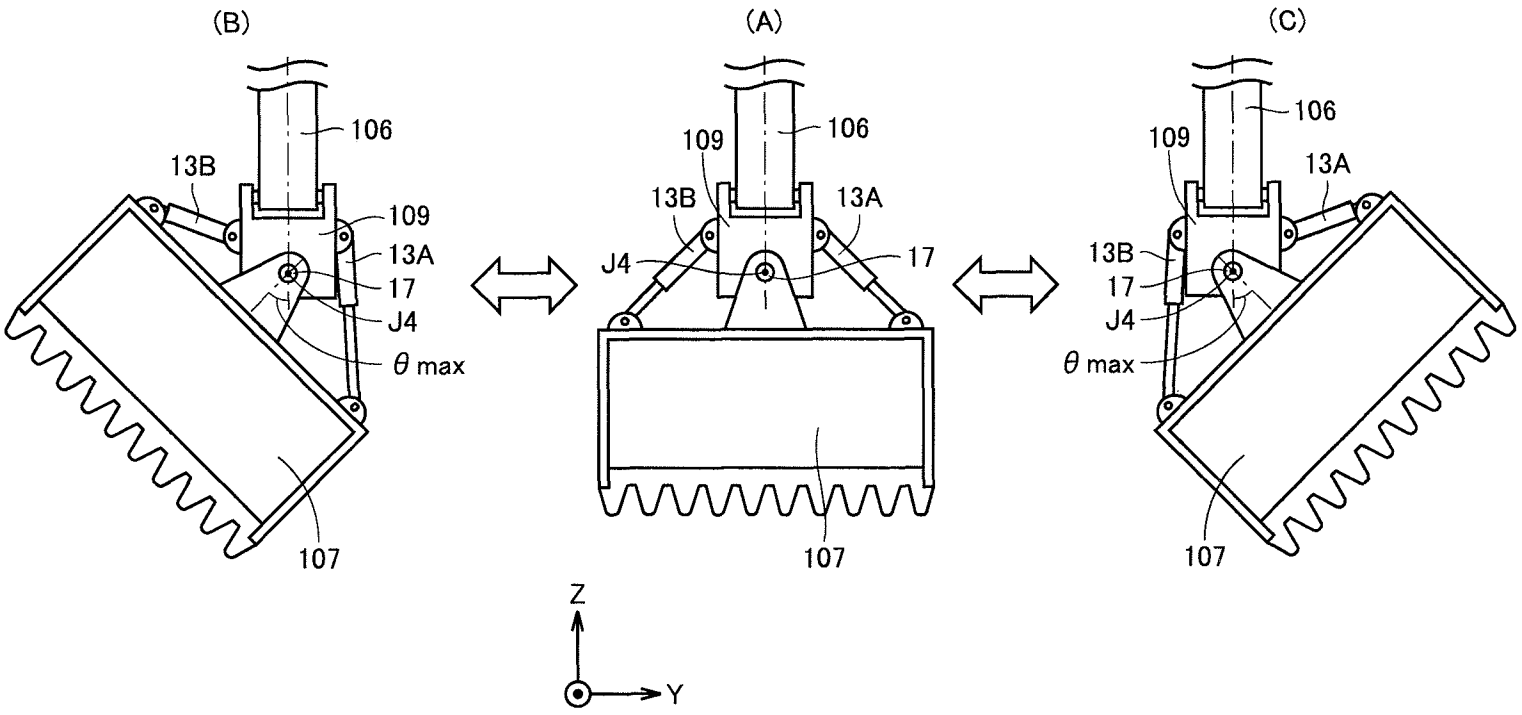
FIG. 2 is a diagram for illustrating a tilting operation of a bucket.

FIG. 2 is a diagram for illustrating a tilting operation of bucket 107. As shown in FIG. 2, tilt cylinders 13A and 13B are provided lateral to tilt pin 17. Tilt cylinder 13A couples bucket 107 and coupling member 109 to each other. A tip end of a cylinder rod of tilt cylinder 13A is coupled to a main body side of bucket 107 and a cylinder tube side of tilt cylinder 13A is coupled to coupling member 109.

Tilt cylinder 13B couples bucket 107 and coupling member 109 to each other similarly to tilt cylinder 13A. A tip end of a cylinder rod of tilt cylinder 13B is coupled to a main body side of bucket 107 and a cylinder tube side of tilt cylinder 13B is coupled to coupling member 109.

FIG. 2 (A) shows bucket 107 in a horizontal state. FIG. 2 (B) shows bucket 107 tilted clockwise to a maximum angle θmax. When tilt cylinder 13A extends as shown as transition from the horizontal state shown in FIG. 2 (A) to a maximally tilted state shown in FIG. 2 (B), tilt cylinder 13B contracts. Thus, bucket 107 pivots clockwise around tilt pin 17, with tilt axis J4 being defined as a pivot center.

FIG. 2 (C) shows bucket 107 tilted counterclockwise to maximum angle θmax. When tilt cylinder 13B extends as shown as transition from the horizontal state shown in FIG. 2 (A) to a maximally tilted state shown in FIG. 2 (C), tilt cylinder 13A contracts. Thus, bucket 107 pivots counterclockwise around tilt pin 17, with tilt axis J4 being defined as the pivot center. Thus, bucket 107 pivots clockwise and counterclockwise around tilt axis J4.

Tilt cylinders 13A and 13B can be extended or contracted by a not-shown operation apparatus in operator's cab 108. As an operator of work vehicle 100 operates the operation apparatus, a hydraulic oil is supplied to or discharged from tilt cylinders 13A and 13B so that tilt cylinders 13A and 13B extend or contract. Consequently, bucket 107 pivots (is tilted) clockwise or counterclockwise by an amount in accordance with an amount of operation. The operation apparatus includes, for example, an operation lever, a slide switch, or a foot pedal.

[Hardware Configuration]

Figure 3:
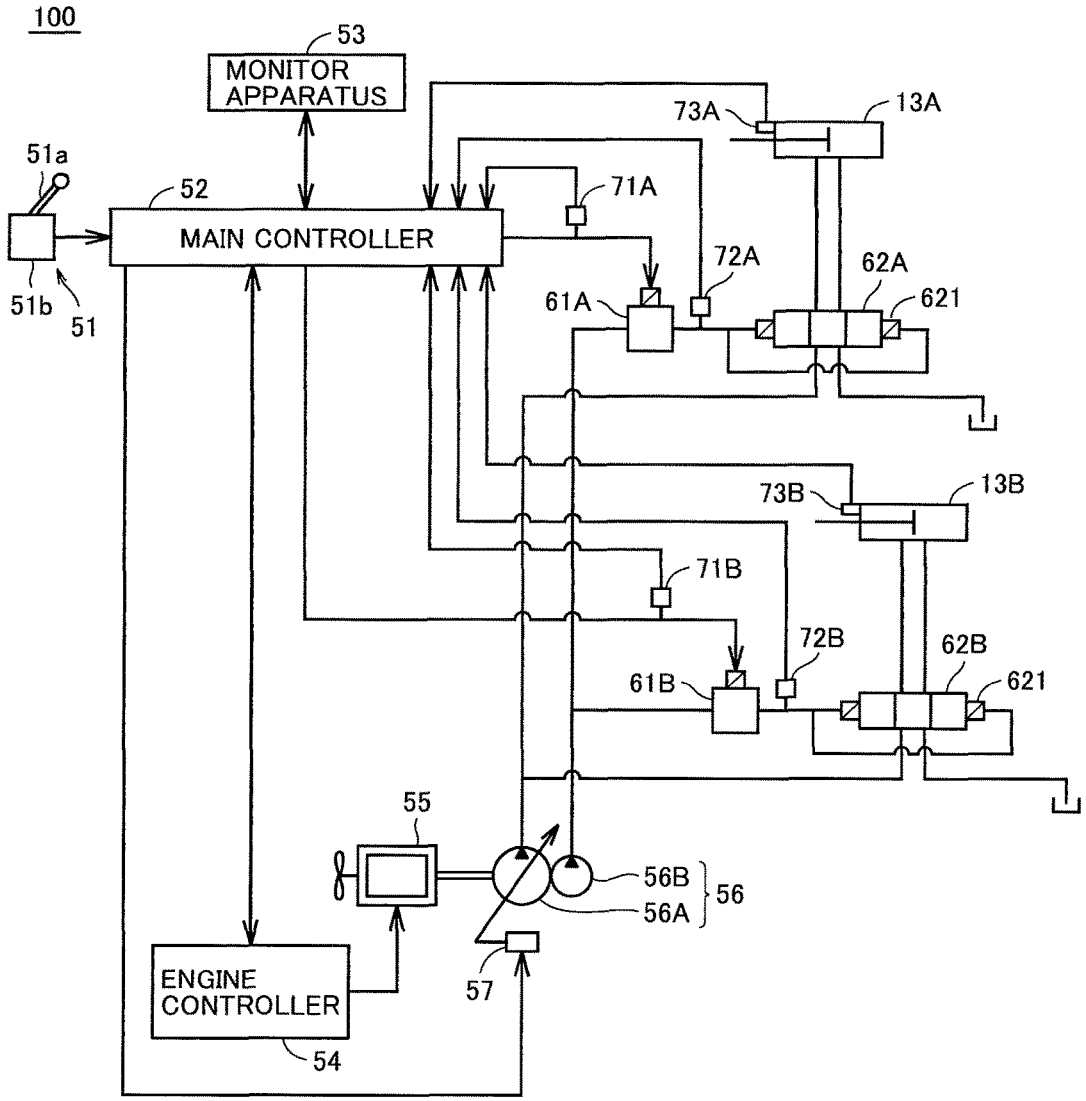
FIG. 3 is a diagram showing a hardware configuration of the work vehicle.

FIG. 3 is a diagram showing a hardware configuration of work vehicle 100.

As shown in FIG. 3, work vehicle 100 includes tilt cylinders 13A and 13B, an operation apparatus 51, a main controller 52, a monitor apparatus 53, an engine controller 54, an engine 55, a hydraulic pump 56, a swash plate driving apparatus 57, electromagnetic proportional control valves 61A and 61B, main valves 62A and 62B, sensors 71A and 71B, sensors 72A and 72B, and sensors 73A and 73B. Hydraulic pump 56 has a main pump 56A supplying a hydraulic oil to work implement 104 and a pilot pump 56B directly supplying oil to electromagnetic proportional control valves 61A and 61B. The electromagnetic proportional control valve is also called an EPC valve.

Operation apparatus 51 is an apparatus for operating work implement 104. In the present embodiment, operation apparatus 51 is an electronic apparatus for tilting bucket 107. Operation apparatus 51 includes an operation lever 51*a* and an operation detector 51*b* detecting an amount of operation of operation lever 51*a*. When an operator of work vehicle 100 operates operation lever 51*a*, operation detector 51*b* outputs an electric signal in accordance with a direction of operation and an amount of operation of operation lever 51*a* to main controller 52.

Monitor apparatus 53 is communicatively connected to main controller 52. Monitor apparatus 53 shows an engine state of work vehicle 100, guidance information, or warning information. Monitor apparatus 53 accepts an instruction for setting in connection with various operations of work vehicle 100. Monitor apparatus 53 notifies main controller 52 of an accepted instruction for setting.

Engine 55 has a driveshaft for connection to hydraulic pump 56. As engine 55 rotates, a hydraulic oil is discharged from hydraulic pump 56. Engine 55 is a diesel engine by way of example.

Engine controller 54 controls an operation of engine 55 in accordance with an instruction from main controller 52. Engine controller 54 adjusts a speed of engine 55 by controlling an amount of injection of fuel injected by a fuel injection apparatus in accordance with an instruction from main controller 52. Engine controller 54 adjusts an engine speed of engine 55 in accordance with a control instruction from main controller 52 for hydraulic pump 56.

Hydraulic pump 56 is driven by engine 55. Main pump 56A delivers a hydraulic oil used for driving work implement 104. Pilot pump 56B delivers a hydraulic oil to electromagnetic proportional control valves 61A and 61B.

Swash plate driving apparatus 57 is connected to main pump 56A. Swash plate driving apparatus 57 is driven based on an instruction from main controller 52 and changes an angle of inclination of a swash plate of main pump 56A.

Main controller 52 is a controller for overall control of operations by work vehicle 100 and implemented by a central processing unit (CPU), a non-volatile memory, and a timer. Main controller 52 controls engine controller 54 and monitor apparatus 53.

Main controller 52 outputs a current having a value in accordance with an amount of operation of operation lever 51*a* to electromagnetic proportional control valves 61A and 61B. When the operation lever is operated in a first direction, main controller 52 outputs a current having a value in accordance with an amount of operation to electromagnetic proportional control valve 61A. When the operation lever is operated in a second direction opposite to the first direction, main controller 52 outputs a current having a value in accordance with an amount of operation to electromagnetic proportional control valve 61B.

Though a configuration in which main controller 52 and engine controller 54 are separate from each other is described in the present example, they may be implemented as one common controller.

A delivery port of hydraulic pump 56 communicates with main valves 62A and 62B. Main valves 62A and 62B each have a spool 621. Main valve 62A communicates with an oil chamber of tilt cylinder 13A. Main valve 62B communicates with an oil chamber of tilt cylinder 13B. The delivery port of hydraulic pump 56 also communicates with electromagnetic proportional control valves 61A and 61B.

An oil is directly supplied to electromagnetic proportional control valve 61A from pilot pump 56B. Electromagnetic proportional control valve 61A generates a pilot pressure in accordance with a current value by using the oil supplied from pilot pump 56B. Electromagnetic proportional control valve 61A drives spool 621 of main valve 62A with the pilot pressure.

Main valve 62A is provided between electromagnetic proportional control valve 61A and tilt cylinder 13A operating bucket 107. Main valve 62A supplies a hydraulic oil in an amount in accordance with a position of spool 621 to tilt cylinder 13A.

Similarly to electromagnetic proportional control valve 61A, an oil is directly supplied to electromagnetic proportional control valve 61B from pilot pump 56B. Electromagnetic proportional control valve 61B generates a pilot pressure in accordance with a current value by using the oil supplied from pilot pump 56B. Electromagnetic proportional control valve 61B drives spool 621 of main valve 62B with the pilot pressure.

Main valve 62B is provided between electromagnetic proportional control valve 61B and tilt cylinder 13B operating and tilting bucket 107. Main valve 62B supplies a hydraulic oil in an amount in accordance with a position of spool 621 to tilt cylinder 13B.

Thus, electromagnetic proportional control valve 61A controls a flow rate of a hydraulic oil supplied to tilt cylinder 13A with the pilot pressure. Electromagnetic proportional control valve 61B controls a flow rate of a hydraulic oil supplied to tilt cylinder 13B with the pilot pressure. Thus, tilt cylinders 13A and 13B extend or contract so that bucket 107 pivots clockwise and counterclockwise around tilt pin 17.

In work vehicle 100, pilot pressures in accordance with values for currents output from main controller 52 to electromagnetic proportional control valves 61A and 61B are output from electromagnetic proportional control valves 61A and 61B to main valves 62A and 62B, respectively. Tilt cylinders 13A and 13B move at speeds in accordance with the pilot pressures output from electromagnetic proportional control valves 61A and 61B to main valves 62A and 62B, respectively. Therefore, in work vehicle 100, tilt cylinders 13A and 13B move at speeds in accordance with the values for the currents output from main controller 52 to electromagnetic proportional control valves 61A and 61B, respectively.

Though a construction in which hydraulic pump 56 has main pump 56A supplying a hydraulic oil to work implement 104 and pilot pump 56B supplying an oil to electromagnetic proportional control valves 61A and 61B has been described above by way of example, limitation thereto is not intended. For example, a hydraulic pump supplying a hydraulic oil to work implement 104 and a hydraulic pump supplying an oil to electromagnetic proportional control valves 61A and 61B may be implemented as the same hydraulic pump (a single hydraulic pump). In this case, a flow of an oil delivered from this hydraulic pump should be branched before reaching work implement 104 so that the oil is supplied to electromagnetic proportional control valves 61A and 61B with a pressure of the branched oil being reduced.

Sensor 71A measures a value for a current output from main controller 52 to electromagnetic proportional control valve 61A and outputs a result of measurement to main controller 52. Sensor 71B measures a value for a current output from main controller 52 to electromagnetic proportional control valve 61B and outputs a result of measurement to main controller 52.

Sensor 72A measures a pilot pressure output from electromagnetic proportional control valve 61A to main valve 62A and outputs a result of measurement to main controller 52. Sensor 72B measures a pilot pressure output from electromagnetic proportional control valve 61B to main valve 62B and outputs a result of measurement to main controller 52.

Position sensor 73A is attached to a cylinder head of tilt cylinder 13A. Position sensor 73A is a stroke sensor measuring a stroke length of a piston of tilt cylinder 13A. Position sensor 73B is attached to a cylinder head of tilt cylinder 13B. Position sensor 73B is a stroke sensor measuring a stroke length of a piston of tilt cylinder 13B.

Position sensors 73A and 73B are electrically connected to main controller 52. Stroke lengths of tilt cylinders 13A and 13B are measured based on detection signals from position sensors 73A and 73B, respectively, and the measured stroke lengths are output to main controller 52. Main controller 52 can calculate a position and an attitude of bucket 107 based on input stroke lengths of tilt cylinders 13A and 13B.

[Configuration of Position Sensor]

Figure 4:
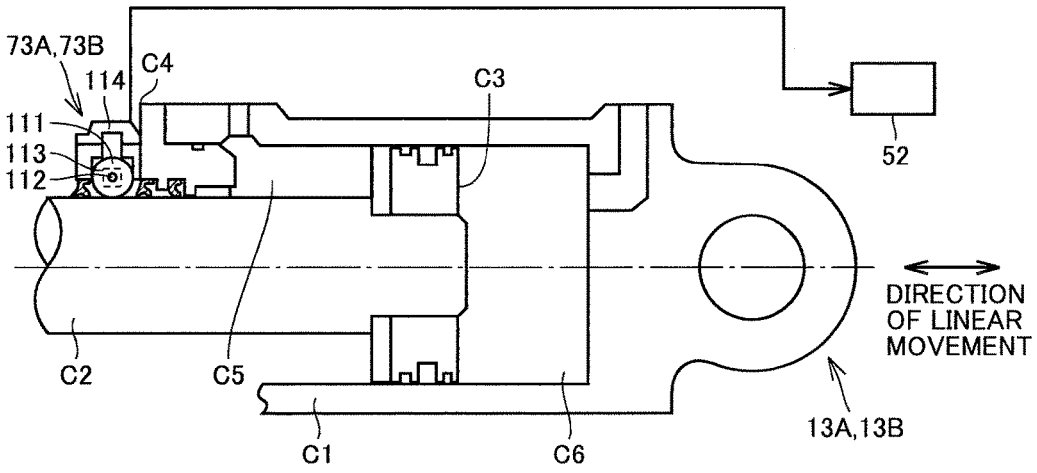
FIG. 4 is a diagram illustrating a position sensor.

FIG. 4 is a diagram illustrating position sensor 73A or 73B.

As shown in FIG. 4, position sensors 73A and 73B are provided in tilt cylinders 13A and 13B, respectively. Though positions sensors 73A and 73B attached to tilt cylinders 13A and 13B, respectively, are described for the sake of convenience of description, a similar position sensor is attached also to another hydraulic cylinder.

Each of tilt cylinders 13A and 13B has a cylinder tube C1 and a cylinder rod C2. Cylinder rod C2 is movable relative to cylinder tube C1 within cylinder tube C1. In cylinder tube C1, a piston C3 is slidably provided with respect to cylinder tube C1. Cylinder rod C2 is attached to piston C3. Cylinder rod C2 is slidably provided in a cylinder head C4.

A chamber delimited by cylinder head C4, piston C3, and an inner wall of the cylinder constitute an oil chamber C5 on a side of the cylinder head. A chamber opposite to oil chamber C5 on the side of the cylinder head with piston C3 being interposed implements an oil chamber C6 on a side of a cylinder bottom. In cylinder head C4, a sealing member for hermetically sealing a gap between cylinder head C4 and cylinder rod C2 for preventing dust from entering oil chamber C5 on the side of the cylinder head is provided.

As a hydraulic oil is supplied to oil chamber C5 on the side of the cylinder head and the hydraulic oil is drained from oil chamber C6 on the side of the cylinder bottom, cylinder rod C2 moves rearward. As the hydraulic oil is drained from oil chamber C5 on the side of the cylinder head and the hydraulic oil is supplied to oil chamber C6 on the side of the cylinder bottom, cylinder rod C2 moves forward. Cylinder rod C2 linearly moves in the lateral direction in the figure.

A case 114 covering position sensor 73A or 73B and accommodating position sensor 73A or 73B is provided at a position outside oil chamber C5 on the side of the cylinder head and is in intimate contact with cylinder head C4. Case 114 is fixed to cylinder head C4 by being fastened to cylinder head C4 with a bolt or the like.

Each of position sensors 73A and 73B has a rotational roller 111, a central rotation shaft 112, and a rotation sensor portion 113. Rotational roller 111 has its surface in contact with a surface of cylinder rod C2 and is provided as being rotatable with linear movement of cylinder rod C2. Rotational roller 111 converts a linear motion of cylinder rod C2 into a rotational motion. Central rotation shaft 112 is arranged as being orthogonal to a direction of linear movement of cylinder rod C2.

Rotation sensor portion 113 is configured to be able to detect an amount of rotation (an angle of rotation) of rotational roller 111. A signal indicating an amount of rotation (an angle of rotation) of rotational roller 111 detected by rotation sensor portion 113 is sent to main controller 52 through an electric signal line. Main controller 52 converts a signal indicating the amount of rotation into a position of cylinder rod C2 of tilt cylinder 13A or 13B (stroke position).

[Configuration of Sensor Abnormal Condition Sensing System]

Figure 5:
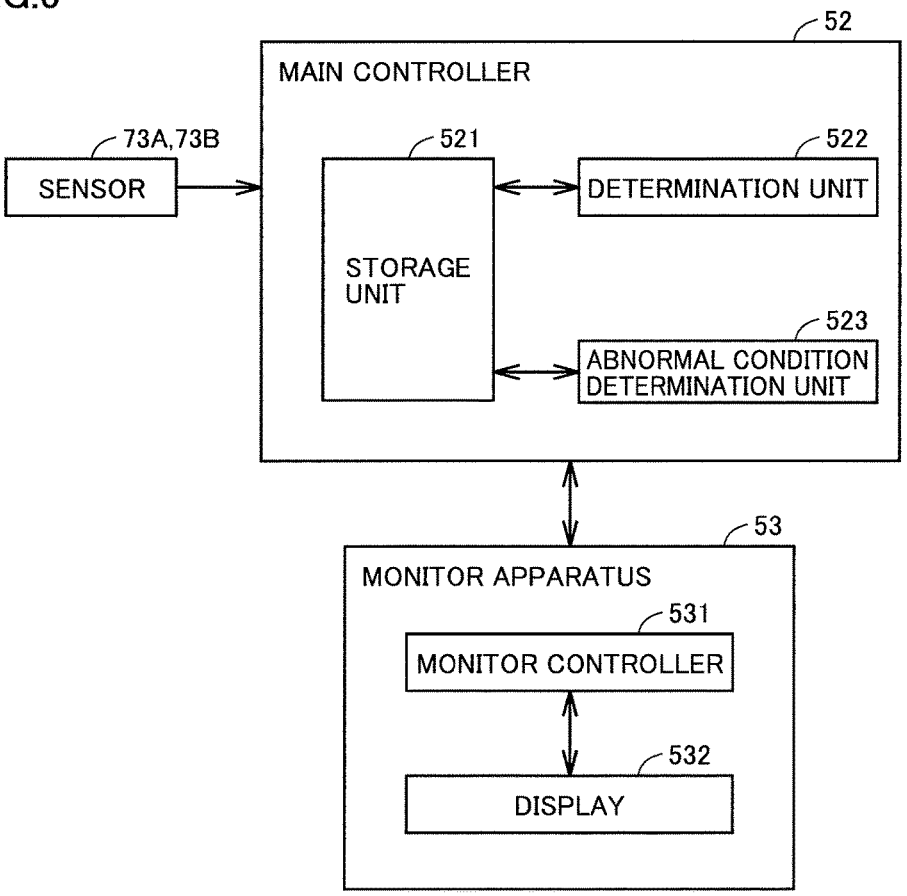
FIG. 5 is a block diagram showing a functional configuration of a sensor abnormal condition sensing system based on an embodiment.

FIG. 5 is a block diagram showing a functional configuration of a sensor abnormal condition sensing system based on an embodiment. As shown in FIG. 5, work vehicle 100 includes main controller 52, monitor apparatus 53, and position sensors 73A and 73B.

Main controller 52 includes a storage unit 521, a determination unit 522, and an abnormal condition determination unit 523. Monitor apparatus 53 includes a monitor controller 531 and a display 532.

Monitor controller 531 stores information on an attachment of work implement 104 such as bucket 107. An operator can input information on an attachment to monitor apparatus 53 by operating display 532. Thus, a file including information on an attachment is prepared for each attachment. Such a file is stored in monitor controller 531. An attachment includes bucket 107 in the embodiment which is a tilting bucket and a conventional bucket which cannot be tilted. Alternatively, the attachment includes an attachment other than the bucket, such as a breaker.

Information on the attachment includes information on whether or not the attachment has a sensor. Monitor controller 531 stores information on whether or not the attachment has a sensor. For example, bucket 107 described above has position sensors 73A and 73B for detecting stroke positions of respective tilt cylinders 13A and 13B. Monitor controller 531 stores information that bucket 107 is an attachment having position sensors 73A and 73B. Monitor controller 531 stores information that a conventional bucket is an attachment without a sensor.

A sensor in the attachment is not limited to a stroke sensor measuring a stroke length of a piston of a cylinder and any sensor is applicable. For example, when a bucket is attached to an arm with a tilt rotator being interposed, the sensor in the attachment may be a sensor detecting an angle of pivot of the bucket with respect to the arm, such as a rotary encoder.

The information on the attachment includes information on a shape of an attachment. Monitor controller 531 stores information on a shape of the attachment. For example, monitor controller 531 stores information on an angle and a distance between two points representing an outer geometry of a bucket such as a distance between bucket pin 16 and cutting edge 1071*a* of bucket 107. The information on the attachment may include information on a weight of the attachment.

The information on the attachment may include information on a result of calibration of data for predicting an operation speed of the attachment. For example, the information on the attachment may include information on a result of calibration of data defining relation between operation speeds of tilt cylinders 13A and 13B for having bucket 107 perform a tilting operation and pilot pressures generated by electromagnetic proportional control valves 61A and 61B. Alternatively, the information on the attachment may include information on a result of calibration of data defining relation between an operation speed of a cylinder driving the attachment and a travel distance of the spool of a direction control valve supplying a hydraulic oil to the cylinder.

Storage unit 521 stores an operating system and various types of data. Determination unit 522 determines whether or not a currently attached attachment is an attachment having a sensor based on information on the attachment stored in monitor controller 531 and information on the attachment currently attached to work implement 104.

When the attachment has a sensor, main controller 52 receives a signal indicating a result of detection by the sensor from the attachment. When bucket 107 is employed as the attachment, main controller 52 receives signals indicating stroke lengths of tilt cylinders 13A and 13B from respective position sensors 73A and 73B. When determination unit 522 determines that the attachment has the sensor and when abnormal condition determination unit 523 cannot receive a signal from the sensor, abnormal condition determination unit 523 determines that some kind of an abnormal condition associated with the sensor such as failure of the sensor itself or break of a line connected to the sensor has occurred.

When abnormal condition determination unit 523 determines that the abnormal condition has occurred, a warning indicating that the abnormal condition has occurred is shown on display 532 of monitor apparatus 53. Display 532 of monitor apparatus 53 has a function as a notification unit visually notifying an operator who operates work vehicle 100 of the abnormal condition. Work vehicle 100 may include an auralizing apparatus such as a speaker notifying an operator of the abnormal condition through voice and sound when abnormal condition determination unit 523 determines that the abnormal condition has occurred.

[Operation of Sensor Abnormal Condition Sensing System]

Figure 6:
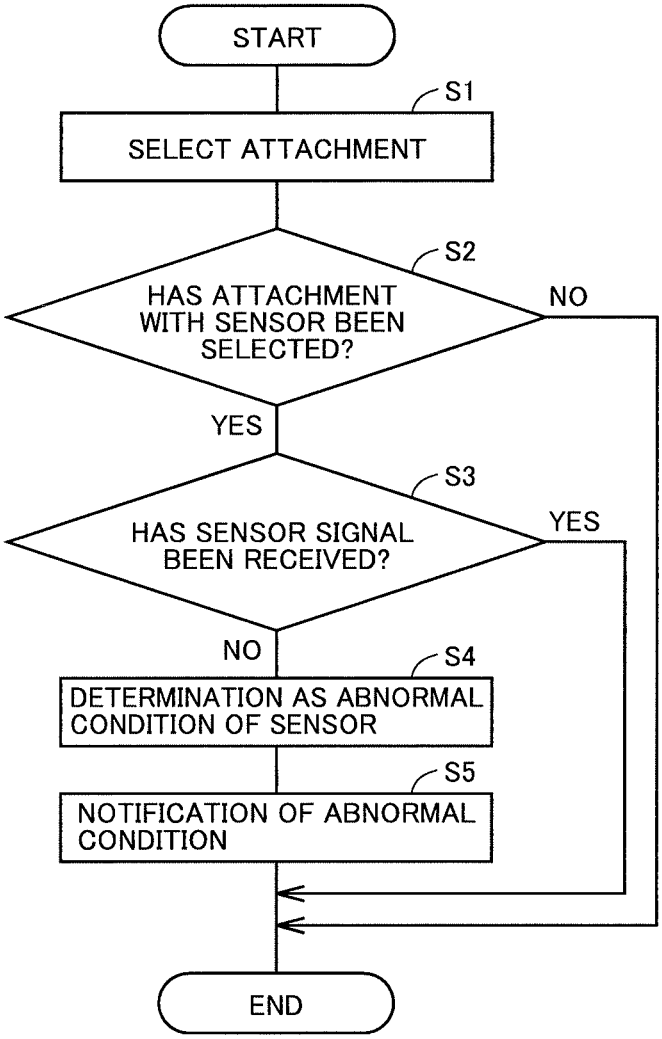
FIG. 6 is a flowchart illustrating an operation of the sensor abnormal condition sensing system.

FIG. 6 is a flowchart illustrating an operation of the sensor abnormal condition sensing system.

Figure 7:
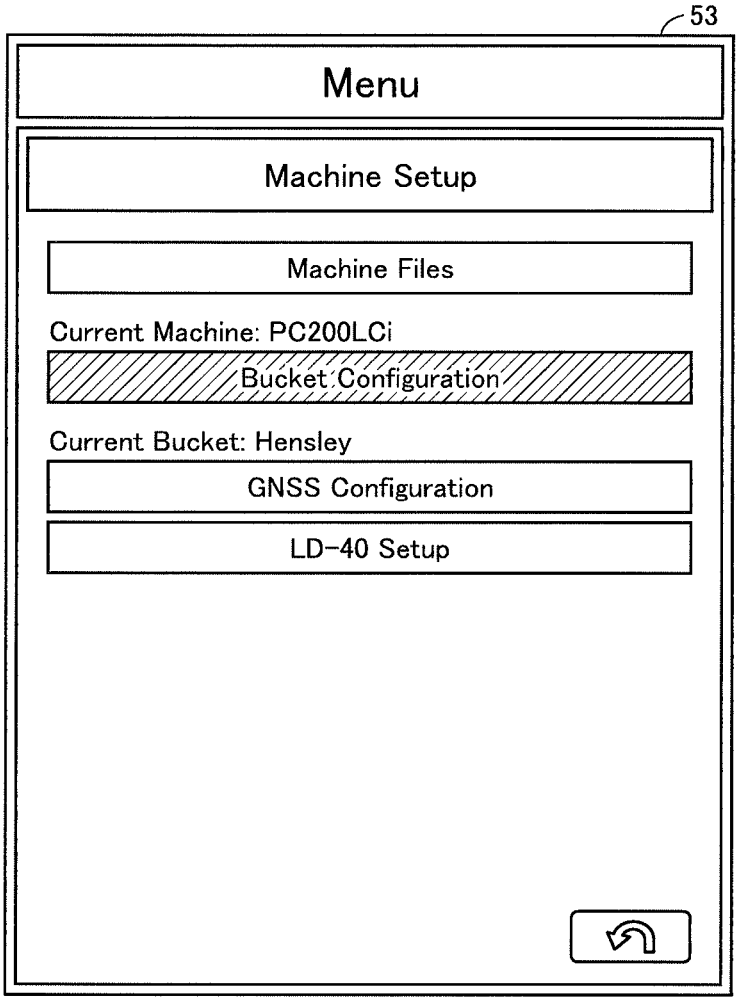
FIG. 7 shows a user interface shown when an attachment is selected.
Figure 8:
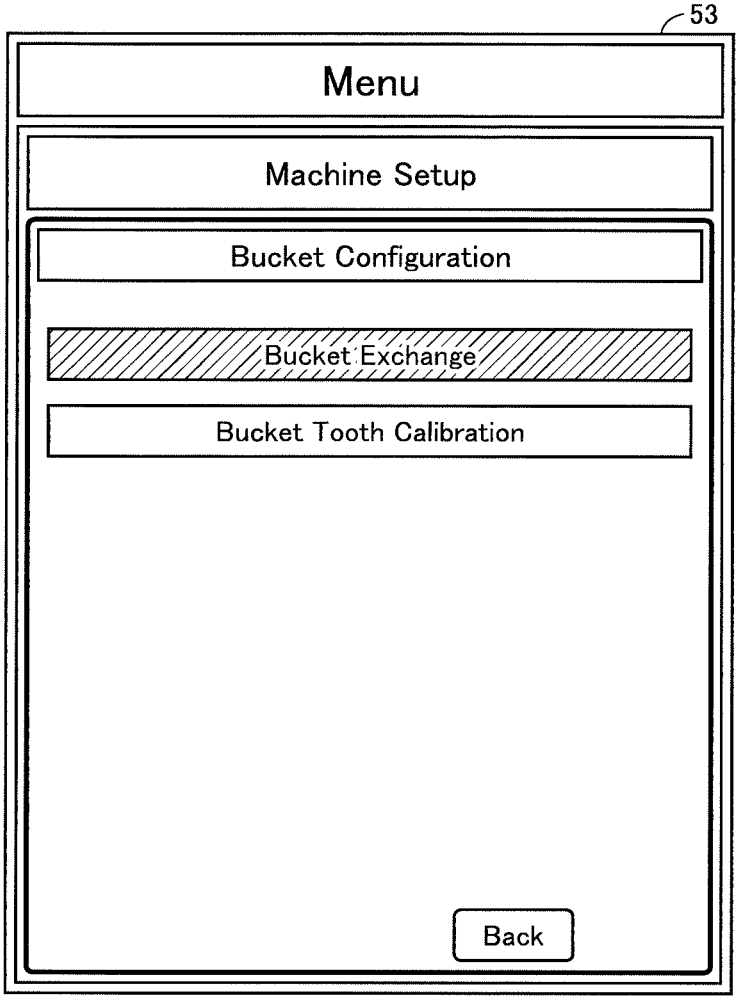
FIG. 8 shows a user interface shown when an attachment is selected.
Figure 9:
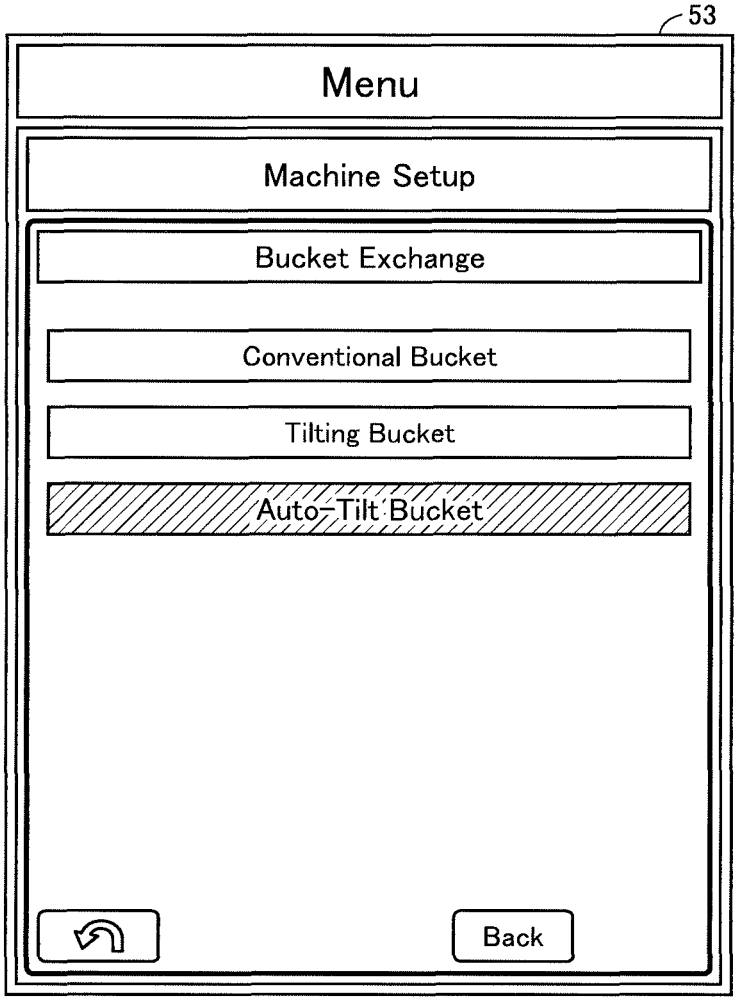
FIG. 9 shows a user interface shown when an attachment is selected.

As shown in FIG. 6, initially in step S1, an attachment is selected. FIGS. 7 to 9 each show a user interface shown when an attachment is selected.

As shown in FIG. 7, monitor apparatus 53 shows on display 532, a user interface showing a machine setup menu in accordance with an instruction from main controller 52. When an operator selects an item "Bucket Configuration" shown in FIG. 7, monitor apparatus 53 shows on display 532, the user interface shown in FIG. 8. When the operator selects an item "Bucket Exchange" shown in FIG. 8, monitor apparatus 53 shows on display 532, the user interface shown in FIG. 9.

In the item "Conventional Bucket" shown in FIG. 9, a file including information on a conventional bucket which is not a tilting bucket is registered. In an item "Tilting Bucket," a file including information on a bucket which is a tilting bucket but does not have a sensor is registered. In an item "Auto-Tilt bucket," a file including information on a tilting bucket having a sensor is registered. The operator selects one of the three items shown in FIG. 9 in accordance with a type of a currently used attachment (bucket) or an attachment (bucket) to be replaced, and selects any of files of attachments shown in succession. An attachment is thus selected.

Then, in step S2, whether or not an attachment with a sensor has been selected is determined. When the item "Conventional Bucket" or "Tilting Bucket" is selected from among the three items shown in the user interface in FIG. 9, it is determined that an attachment with a sensor has not been selected. When the item "Auto-Tilt bucket" is selected from among the three items shown in FIG. 9, it is determined that an attachment with a sensor has been selected.

When it is determined that an attachment with a sensor has been selected (YES in step S2), the process proceeds to step S3 and whether or not a sensor signal has been received is determined. When bucket 107 in the embodiment is employed as the attachment, whether or not main controller 52 has received signals indicating stroke lengths of tilt cylinders 13A and 13B from position sensors 73A and 73B is determined. When an attachment has a plurality of sensors like bucket 107 in the embodiment having position sensors 73A and 73B, whether or not a sensor signal has been received is determined for each sensor.

When it is determined that a sensor signal has not been received (NO in step S3), the process proceeds to step S4 and it is determined that an abnormal condition such as a failure of the sensor itself or break has occurred. A notification about the abnormal condition is then given in step S5. When the attachment has a plurality of sensors, a notification about in which of the plurality of sensors the abnormal condition has occurred is given.

Figure 10:
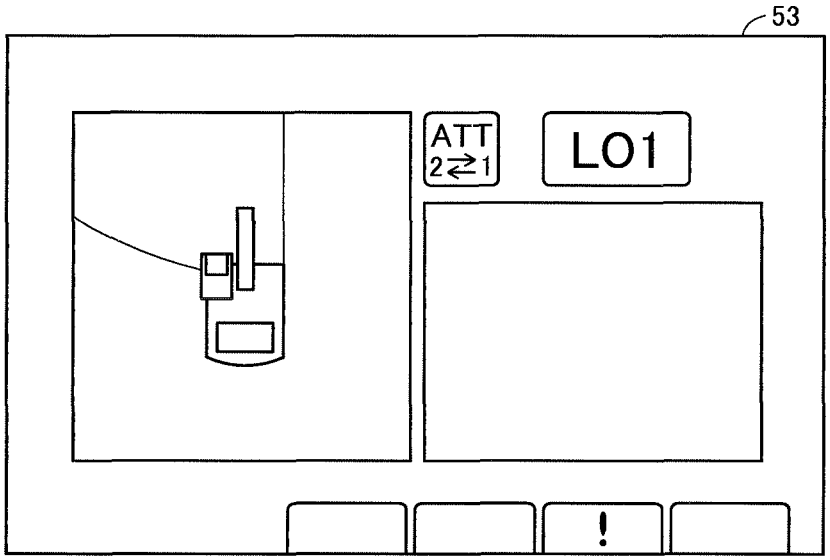
FIG. 10 shows a user interface showing a warning when a sensor is in an abnormal condition.
Figure 11:
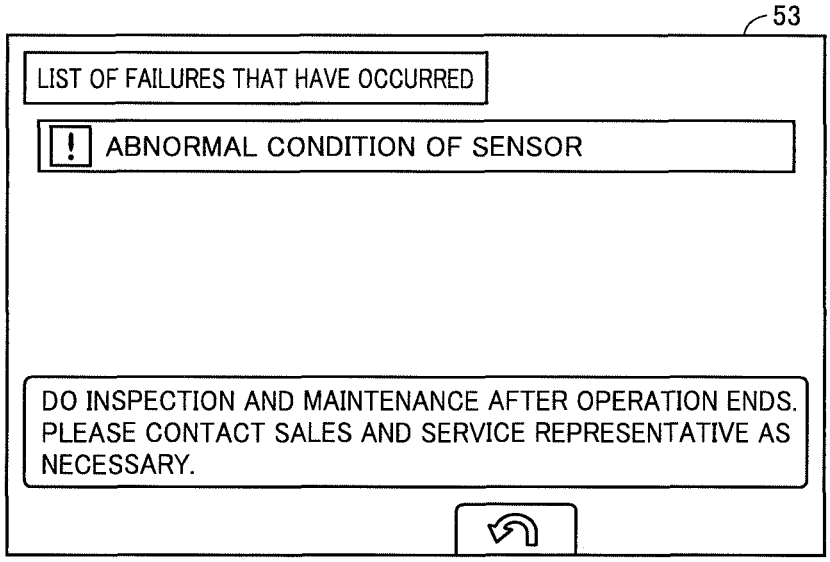
FIG. 11 shows a user interface showing a warning when a sensor is in an abnormal condition.

FIGS. 10 and 11 each show a user interface showing a warning when the abnormal condition of the sensor occurs. As shown in FIG. 10, when it is determined that the abnormal condition of the sensor has occurred while monitor apparatus 53 shows an image around work vehicle 100 picked up by a camera, representation for giving a warning is provided in a part of a screen. When an operator selects a "warning" tab in a lower portion of the screen, a message that the abnormal condition of the sensor has occurred is shown as shown in FIG. 11.

Then, the process ends (end).

When it is determined in determination in step S2 that an attachment with a sensor has not been selected (NO in step S2) and determined in determination in step S3 that a sensor signal has been received (YES in step S3), determination as occurrence of the abnormal condition is not made and the process ends (end) without a notification about the abnormal condition being given.

Since the main controller will not receive a signal from a sensor unless an attachment has a sensor, it is not determined that an abnormal condition has occurred without receiving a sensor signal.

[Function and Effect]

The construction and a function and effect of work vehicle 100 in the embodiment described above will be described as being summarized below. Reference numerals are provided to features in the embodiment by way of example.

As shown in FIG. 1, work vehicle 100 has work implement 104. Work implement 104 has bucket 107 representing a removable attachment. As shown in FIG. 3, work vehicle 100 includes main controller 52 controlling an operation of work vehicle 100. As shown in FIG. 5, main controller 52 includes determination unit 522 and abnormal condition determination unit 523. As shown in FIG. 6, determination unit 522 determines whether or not an attachment has a sensor based on information on an attachment. When determination unit 522 determines that the attachment has a sensor and when abnormal condition determination unit 533 cannot receive a signal from the sensor, the abnormal condition determination unit determines that an abnormal condition has occurred.

When the attachment has the sensor and when main controller 52 cannot receive a signal from the sensor, it is determined that some kind of abnormal condition associated with the sensor such as a failure of the sensor itself or break has occurred. It is not necessary for a serviceperson to conduct measurement for determining an abnormal condition of the sensor with the use of a dedicated instrument. Therefore, an abnormal condition of the sensor can easily and quickly be sensed.

As shown in FIG. 9, information on the attachment may include information on a shape of the attachment. By individually registering information on a shape of the attachment and information on whether or not the attachment has a sensor for each attachment, when an attachment in a specific shape is selected, whether or not the selected attachment has a sensor can readily be determined.

As shown in FIG. 9, the information on the attachment may include information on the attachment having the sensor and information on the attachment without a sensor. By individually registering information on whether or not an attachment has a sensor for each attachment, when a specific attachment is selected, whether or not the selected attachment has a sensor can readily be determined.

As shown in FIG. 1, bucket 107 may be employed as the attachment. When bucket 107 has a sensor, an abnormal condition of the sensor can easily and quickly be sensed.

As shown in FIG. 1, work implement 104 has boom 105 attached to the vehicular main body as being pivotable with respect to the vehicular main body and arm 106 attached to boom 105 as being pivotable with respect to boom 105. Bucket 107 may be attached to arm 106 as being pivotable around bucket axis J3 defining the axis of pivot with respect to arm 106 and around tilt axis J4 orthogonal to bucket axis J3. In this case, an abnormal condition of position sensors 73A and 73B of bucket 107 which is a tilting bucket can easily and quickly be sensed.

As shown in FIGS. 10 and 11, work vehicle 100 may further include a notification unit giving a notification about an abnormal condition when abnormal condition determination unit 523 determines that an abnormal condition has occurred. Thus, an operator who operates work vehicle 100 can quickly recognize an abnormal condition of the sensor.

An example in which monitor controller 531 stores information on an attachment has been described in the description of the embodiment so far. Information on an attachment may be recorded in storage unit 521 of main controller 52. Alternatively, when work vehicle 100 includes a communication unit for communicating with the outside and when a specific attachment is selected, information on a selected attachment may be received through communication from an external storage device.

Though main controller 52 mounted on work vehicle 100 includes determination unit 522 and abnormal condition determination unit 523 in the description of the embodiment, limitation to this configuration is not intended. Work vehicle 100 is not limited to such specifications that an operator gets on operator's cab 108 and operates work vehicle 100, and the specifications may be such that the work vehicle is operated by being remotely externally controlled. When the work vehicle is remotely controlled, an external controller should only have a determination unit and an abnormal condition determination unit. Therefore, a controller mounted on work vehicle 100 does not have to have determination unit 522 and abnormal condition determination unit 523.

Work vehicle 100 is not limited to the hydraulic excavator described in the embodiment. An attachment removably attached to the work implement may be a bucket attached to a wheel loader, a blade of a crawler dozer, or a blade of a motor grader.

Though the embodiment of the present invention has been described above, it should be understood that the embodiment disclosed herein is illustrative and non-restrictive in every respect. The scope of the present invention is defined by the terms of the claims and is intended to include any modifications within the scope and meaning equivalent to the terms of the claims.

REFERENCE SIGNS LIST

10 boom cylinder; 11 arm cylinder; 12 bucket cylinder; 13A, 13B tilt cylinder; 14 boom pin; 15 arm pin; 16 bucket pin; 17 tilt pin; 51 operation apparatus; 51*a* operation lever; 51*b* operation detector; 52 main controller; 53 monitor apparatus; 61A, 61B electromagnetic proportional control valve; 62A, 62B main valve; 73A, 73B position sensor; 100 work vehicle; 104 work implement; 105 boom; 106 arm; 107 bucket; 108 operator's cab; 109 coupling member; 521 storage unit; 522 determination unit; 523, 533 abnormal condition determination unit; 531 monitor controller; 532 display; 621 spool; 1071 blade; 1071*a* cutting edge; J1 boom axis; J2 arm axis; J3 bucket axis; and J4 tilt axis.

The invention claimed is:

1. A work vehicle comprising:

a vehicular main body;

a work implement attached to the vehicular main body, the work implement having a removable attachment; and a controller controlling an operation of the work vehicle, the controller including a determination unit determining whether the attachment has a sensor based on information on the attachment stored in a storage unit, the information on the attachment including information on whether or not the attachment has the sensor, the controller further including an abnormal condition determination unit determining that an abnormal condition has occurred when the determination unit determines that the attachment has the sensor and when the abnormal condition determination unit cannot receive a signal from the sensor.

2. The work vehicle according to claim 1, wherein the information on the attachment includes information on a shape of the attachment.

3. The work vehicle according to claim 1, wherein the information on the attachment includes information on the attachment having the sensor and information on the attachment without the sensor.

4. The work vehicle according to claim 1, wherein the attachment is a bucket.

5. The work vehicle according to claim 4, wherein the work implement has a boom attached to the vehicular main body as being pivotable with respect to the vehicular main body and an arm attached to the boom as being pivotable with respect to the boom, and the bucket is attached to the arm as being pivotable around a bucket axis defining an axis of pivot with respect to the arm and around a tilt axis orthogonal to the bucket axis.

6. The work vehicle according to claim 1, the work vehicle further comprising a notification unit giving a notification about an abnormal condition when the abnormal condition determination unit determines that an abnormal condition has occurred.

7. A method of controlling a work vehicle, the work vehicle including a vehicular main body and a work implement attached to the vehicular main body, the work implement having a removable attachment, the method comprising:

determining whether the attachment has a sensor based on information on the attachment stored in a storage unit, the information on the attachment including information on whether or not the attachment has the sensor; and determining that an abnormal condition has occurred when it is determined that the attachment has the sensor and when a signal from the sensor cannot be received.

* * * * *